US006303883B1

(12) United States Patent
Ho

(10) Patent No.: US 6,303,883 B1
(45) Date of Patent: Oct. 16, 2001

(54) POWER PLUG

(75) Inventor: Hsien-Wen Ho, Tainan (TW)

(73) Assignee: Chi-Wen Chen, Taipei City (TW)

( * ) Notice: Subject to any disclaimer, the term of this patent is extended or adjusted under 35 U.S.C. 154(b) by 0 days.

(21) Appl. No.: 09/703,991

(22) Filed: Oct. 31, 2000

(51) Int. Cl.[7] ..... H01R 13/70
(52) U.S. Cl. ..... 200/51.12; 200/51 R
(58) Field of Search ..... 200/11 R, 17 R, 200/51 R, 51.05, 51.06, 51.07, 51.11, 51.12, 334, 336, 564, 570, 571

(56) References Cited

U.S. PATENT DOCUMENTS 3,943,310 * 3/1976 Gertz ..... 200/51 R
4,008,382 * 2/1977 DeRosa ..... 200/51 R
4,969,833 * 11/1990 Lindow et al. ..... 439/133
5,193,665 * 3/1993 Jankow ..... 200/43.8

* cited by examiner

*Primary Examiner*—Michael Friedhofer
(74) *Attorney, Agent, or Firm*—Ohlandt, Greeley, Ruggiero & Perle, L.L.P.

(57) ABSTRACT

A power plug includes a seat having a base and a post, first and second conductive plates projecting upwardly from the base, first and second power plug blades projecting through the base, and a switch mounted rotatably on the post and having an end wall disposed above the base, a peripheral wall surrounding the first and second conductive plates, and a bridging plate mounted on the peripheral wall. The switch is turnable about the post between a first position, in which the bridging plate bridges the first and second conductive plates, and a second position, in which the bridging plate disconnects the first and second conductive plates.

11 Claims, 8 Drawing Sheets

POWER PLUG

BACKGROUND OF THE INVENTION

1. Field of the Invention

This invention relates to a power plug, more particularly to a power plug having a switch provided thereon.

2. Description of the Related Art

FIG. 1 illustrates a conventional power plug 1 for an electrical receptacle 10. The power plug 1 includes an insulative housing 11 provided with an electric wire 12 that projects from a rear side of the housing 11 and that has first and second conductors 121, 122 and a ground conductor 123, a pair of parallel power plug blades 112 and a ground pin 113 projecting outwardly from a front side of the housing 11. Portions of the power plug blades 112 and the ground pin 113 are encapsulated in the housing 11 to electrically connect with the first and second conductors 121, 122 and the ground conductor 123, respectively.

The power plug 1 is disadvantageous in that when it is applied to a receptacle which is not provided with an On/Off switch, it can be relatively inconvenient to pull out the same from the receptacle or re-plug the same into the receptacle whenever there is a need to disconnect the same from or re-connect the same to the receptacle. Moreover, chances for the power plug 1 or the receptacle to be damaged are higher when frequency of the pulling and re-plugging operations is higher.

SUMMARY OF THE INVENTION

Therefore, the object of the present invention is to provide a power plug with a switch that is capable of overcoming the aforementioned drawbacks.

According to the present invention, a power plug comprises: an insulative seat having a base and a post projecting upwardly from the base, the base having a pair of slits formed therein at two opposite sides of the post; opposite arc-shaped first and second conductive plates projecting upwardly from the base and spaced radially apart from the post, the first conductive plate being adapted to be connected to a first conductor of an electric wire; first and second power plug blades secured to the base, and projecting downwardly and respectively from the base through the slits, the first power plug blade being adapted to be connected to a second conductor of the electric wire, the second power plug blade being electrically connected to the second conductive plate; and a switch mounted rotatably on the post, and having an end wall disposed above the base, a peripheral wall projecting downwardly from the end wall toward the base, and extending circumferentially to surround the first and second conductive plates, and a conductive arc-shaped bridging plate mounted on the peripheral wall, the switch being turnable about the post between a first position, in which the bridging plate bridges the first and second conductive plates, and a second position, in which the bridging plate disconnects the first and second conductive plates.

BRIEF DESCRIPTION OF THE DRAWINGS

In drawings which illustrate embodiments of the invention.

DETAILED DESCRIPTION OF THE PREFERRED EMBODIMENTS

Figure 1:
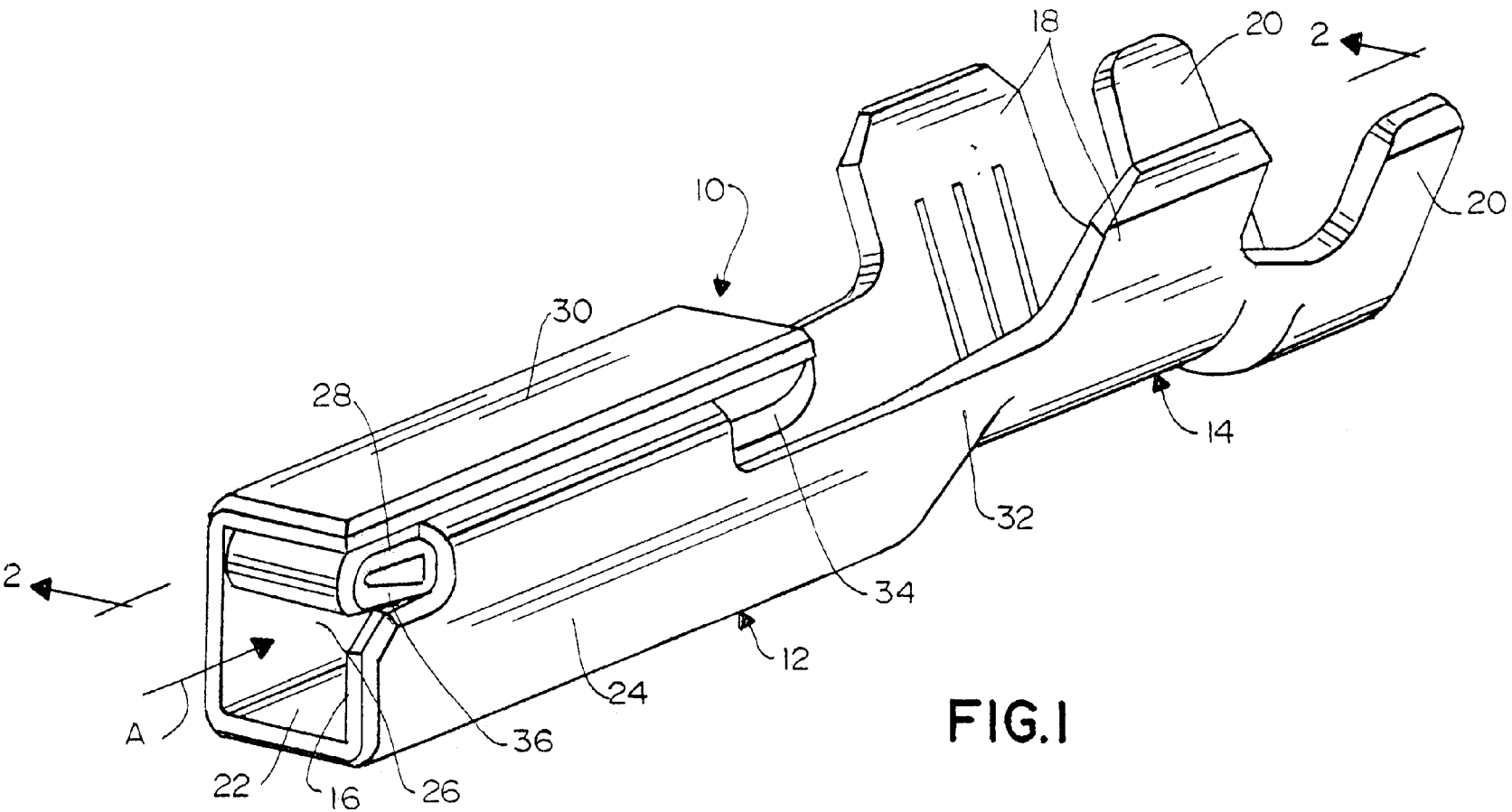
FIG. 1 is a perspective view of a conventional power plug.
Figure 2:
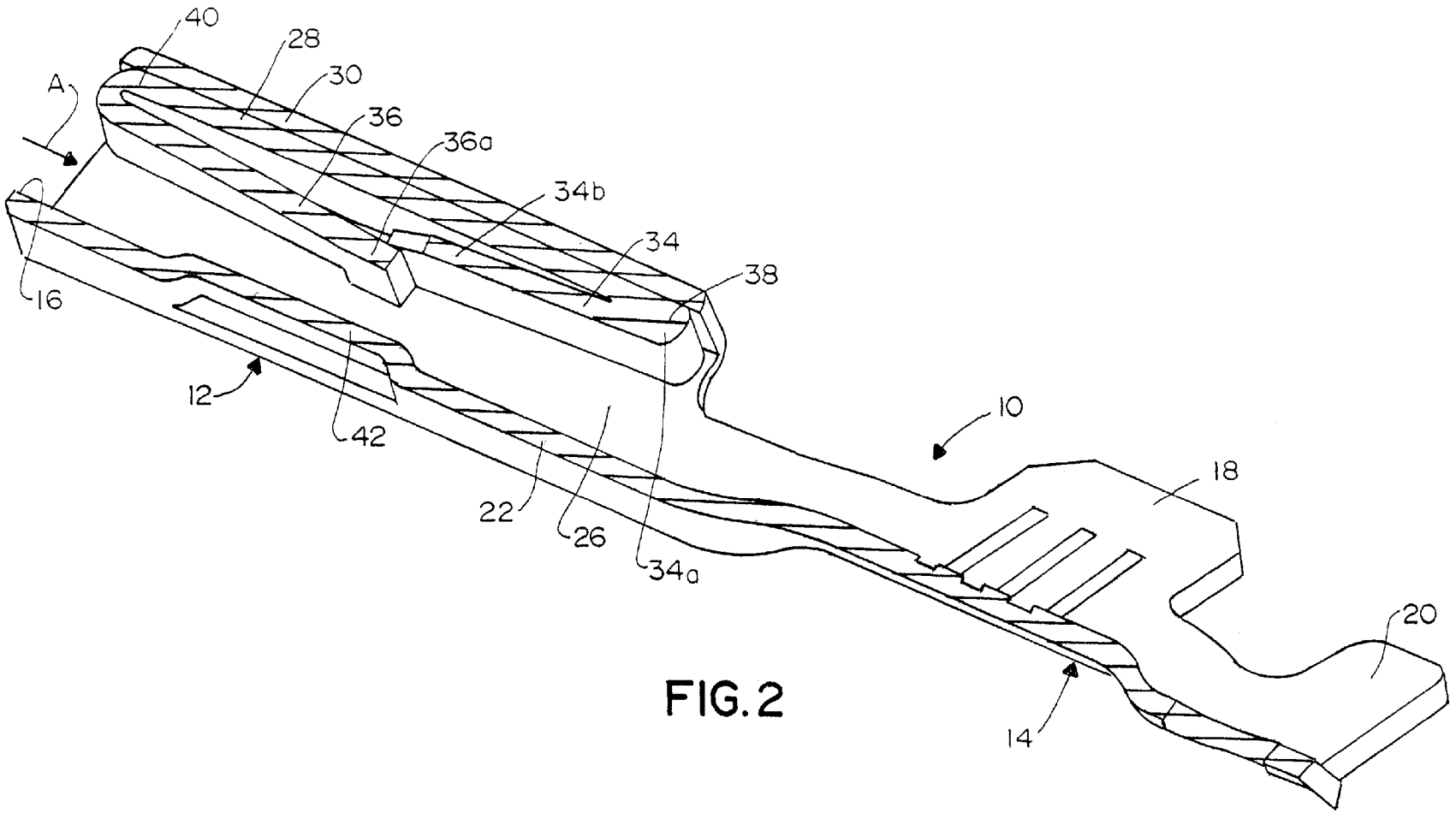
FIG. 2 is an exploded view of a power plug embodying this invention.
Figure 3:
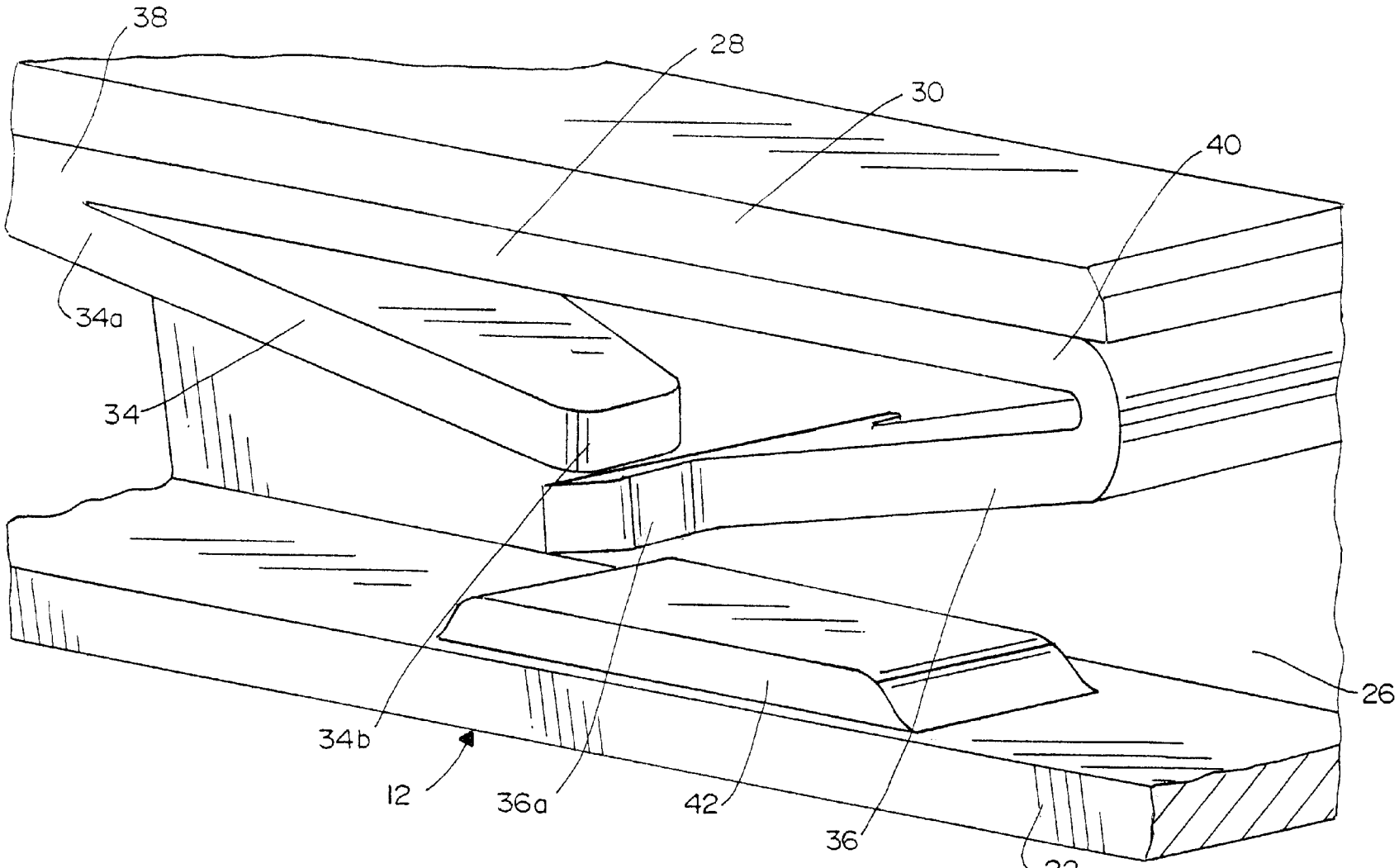
FIG. 3 is a fragmentary exploded view of the power plug of FIG. 2.
Figure 4:
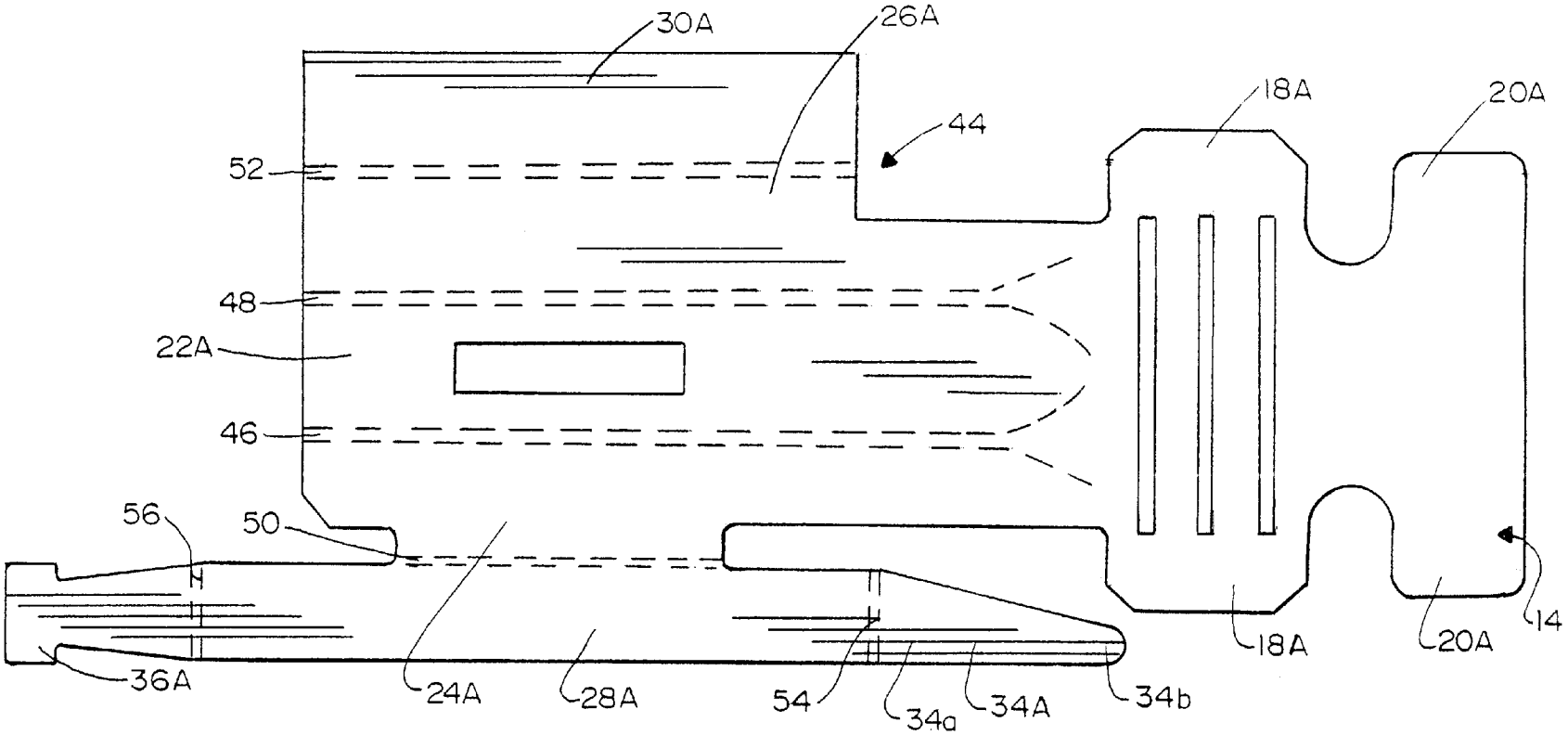
FIG. 4 is another fragmentary exploded view of the power plug of FIG. 2.

FIGS. 2 to 4 illustrate a power plug embodying this invention. The power plug includes an insulative seat 2, a switch 7, an insulative switch supporting member 5, and an insulative positioning lid 6.

The insulative seat 2 includes a base 21 which is substantially circular in shape, a post 22 projecting upwardly from a central position of the base 21, arc-shaped first and second positioning protrusions 25, 26 projecting upwardly from a peripheral edge of the base 21 and spaced radially apart from the post 22, and a C-shaped protrusion 23 projecting upwardly from the base 21 between the first and second positioning protrusions 25, 26 and connected to the post 22. The base 21 has a pair of slits 27, 28 formed therein at two opposite sides of the post 22, and an aperture 24 formed therein adjacent to the C-shaped protrusion 23.

Arc-shaped first and second conductive plates 33, 43 are respectively mounted on the first and second positioning protrusions 25, 26, and have inverted U-shaped portions that respectively define slots 331, 431 which open downwardly and which have shapes respectively conforming to the first and second positioning protrusions 25, 26 so as to receive fittingly the first and second positioning protrusions 25, 26. The first conductive plate 33 is electrically connected to a first conductor 312 of an electric wire 31.

First and second power plug blades 32, 42 are secured to the base 21, and project downwardly from the base 21 through the slits 27, 28, respectively. The first power plug blade 32 is electrically connected to a second conductor 311 of the electric wire 31. The second power plug blade 42 is electrically connected to the second conductive plate 43 via a conductive wire 41. A ground pin 35 is secured to the base 21, projects downwardly from the base 21 through the aperture 24, and has a portion confined by the C-shaped protrusion 23 which limits the ground pin 35 against lateral movement. The ground pin 35 is connected to a ground conductor 313 of the electric wire 31.

The switch supporting member 5, which is made of plastic, is mounted securely on the post 22, and has a lower annular part 51 formed with a plurality of notches and sleeved fittingly around the post 22, and an upper part 53 having a pair of opposite arc-shaped protrusions 531, 532 that project upwardly from the lower annular part 51, that define a slot 52 therebetween, and that respectively have anchoring ends 533.

The positioning lid 6, which is an integral plastic piece, is mounted securely on the base 21, and has a lower annular wall 61 sleeved fittingly around a peripheral edge of the base 21, an upper annular wall 62 reduced and extending upwardly from the lower annular wall 61 to surround fittingly the lower annular part 51 of the switch supporting member 5 and having a top end face flush with a top end face of the lower annular part 51 of the switch supporting member 5, a C-shaped upper wall 64 projecting upwardly from the upper annular wall 62 at a position opposite to the first and second conductive plates 33, 43 and surrounding a portion of the upper part 53 of the switch supporting member 5, and an arc-shaped lip 641 projecting outwardly and radially from a bottom side of the C-shaped upper wall 64. The first and second conductive plates 33, 43 are exposed from an outer surface 63 of the upper annular wall 62. A cord sleeve 65 extends outwardly from the C-shaped upper wall 64 for encapsulating a portion of the electric wire 31 therein.

Figure 5:
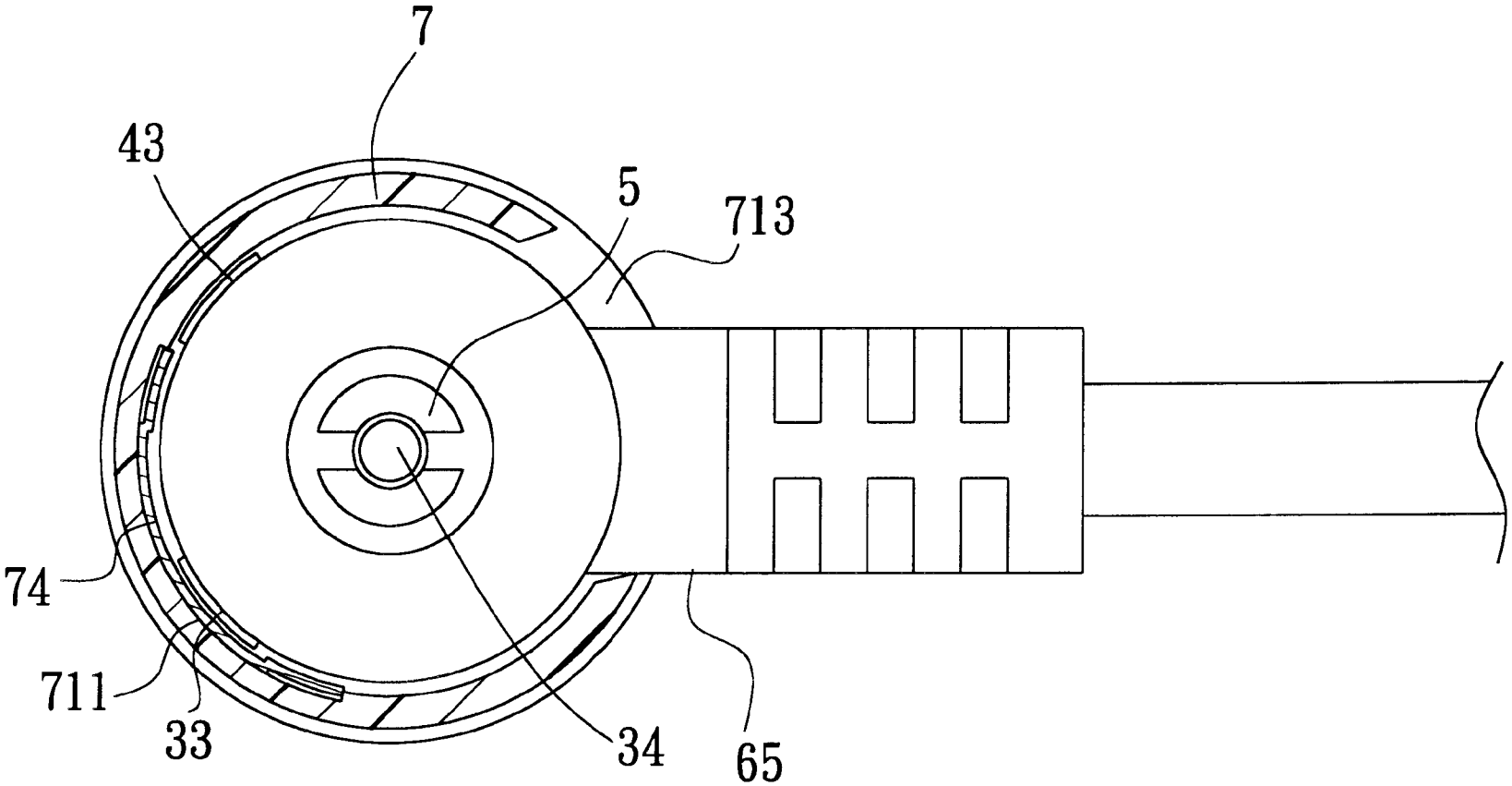
FIG. 5 is a cross-sectional top view to illustrate a switch of the power plug of FIG. 2 in an Off position.
Figure 6:
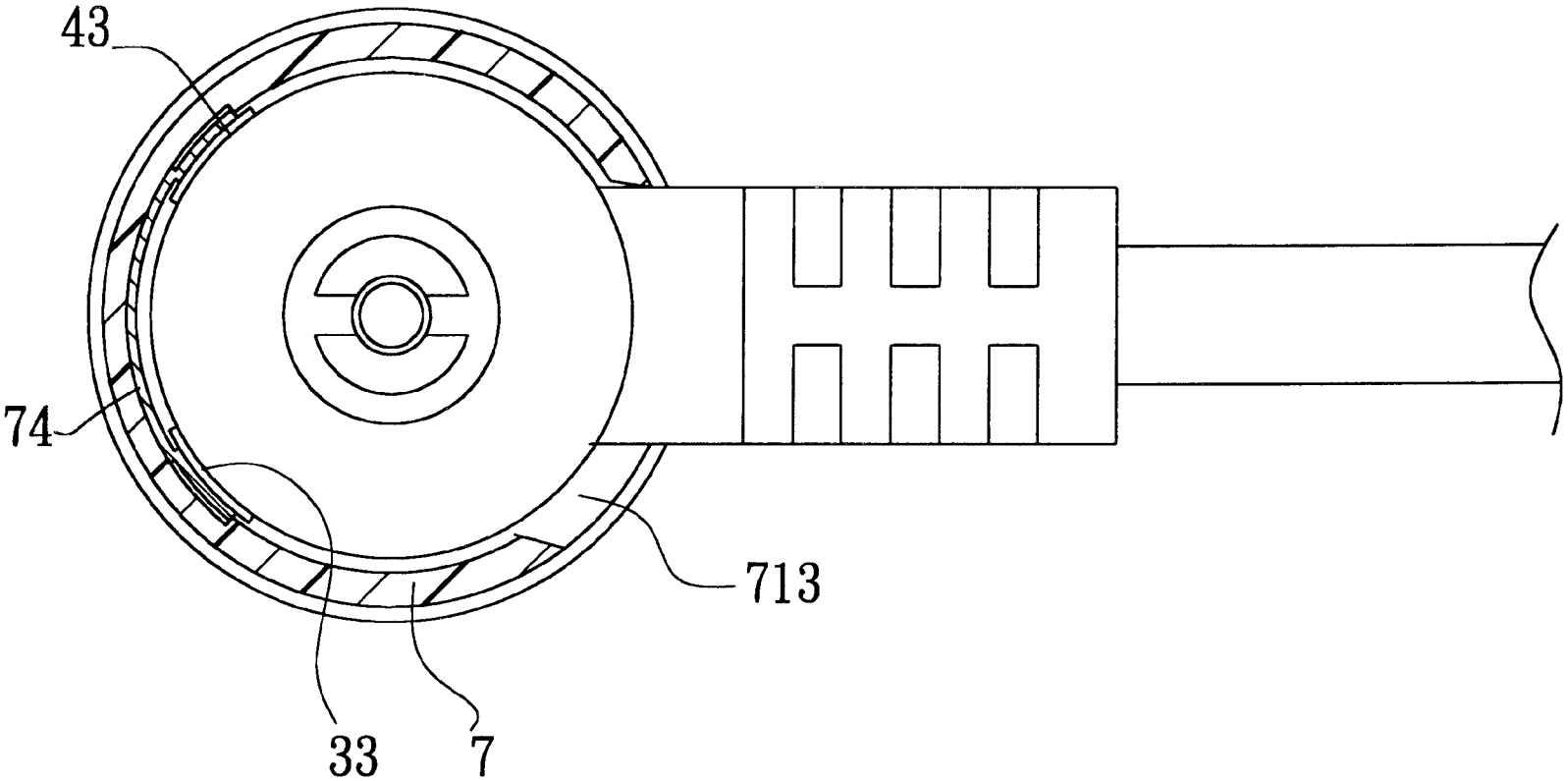
FIG. 6 is a cross-sectional top view to illustrate a switch of the power plug of FIG. 2 in an On position.

The switch 7 is mounted rotatably on the post 22 via the switch supporting member 5 and the positioning lid 6, and has an end wall 72 disposed above the C-shaped upper wall 64 of the positioning lid 6, a peripheral wall 71 projecting downwardly from the end wall 72 to the lower annular wall 61 of the positioning lid 6 and extending circumferentially to surround the first and second conductive plates 33, 43 and the upper annular wall 62, and a conductive arc-shaped bridging plate 74 mounted on the peripheral wall 71. The peripheral wall 71 has an inner recess 711 formed therein and having a shape conforming to the bridging plate 74 for receiving fittingly the bridging plate 74, and a tongue 712 projecting therefrom into the inner recess 711. The bridging plate 74 has a groove 741 that engages the tongue 712 so as to limit the same against circumferential movement. The end wall 72 has a central opening 721 formed therein and aligned with the slot 52 in the upper part 53 of the switch supporting member 5, and an annular flange 722 projecting from a periphery of the central opening 721 to receive the anchoring ends 533 of the protrusions 531, 532 of the upper part 53 of the switch supporting member 5. The annular flange 722 has an inner annular groove 723 formed therein and engaging the anchoring ends 533 of the protrusions 531, 532 of the upper part 53. The peripheral wall 71 further has a circumferentially extending inner groove 710 formed therein and engaging the arc-shaped lip 641 of the positioning lid 6 so as to permit the switch 7 to turn about the post 22 between a first position (see FIG. 6), in which the bridging plate 74 bridges the first and second conductive plates 33, 34, thereby forming a closed circuit in the electric wire 31, and a second position (see FIG. 5), in which the bridging plate 74 disconnects the first and second conductive plates 33, 43, thereby opening the aforesaid circuit. A notch 713 is formed in the peripheral wall 71 opposite to the inner recess 711 for passage of the cord sleeve 65, and has a width that is sufficient enough to allow the switch 7 to move between the first and second positions.

A lamp 34 is mounted in the slot 52, and is electrically connected to the first conductive plate 33 and the first power plug blade 32 to serve as an indicator. A transparent cover 73 is mounted on the end wall 72 of the switch 7 for covering the central opening 721 and for serving as a window for checking the status of the lamp 34 and thus the power plug.

Figure 7:
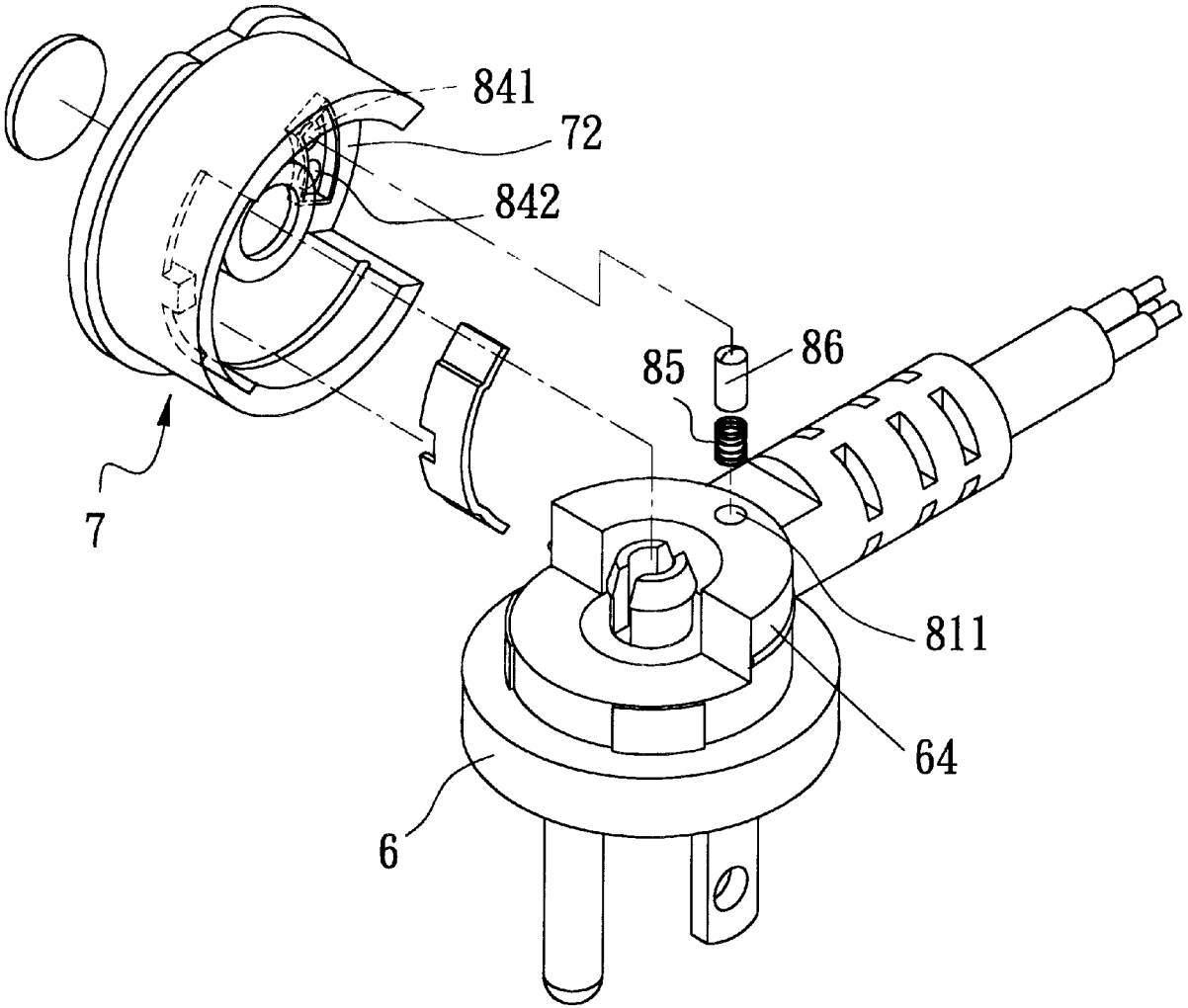
FIG. 7 is an exploded view of a modified power plug of the invention.

FIG. 7 illustrates a modified power plug of the invention. The modified power plug is similar to the previous embodiment shown in FIG. 2, except that a positioning mechanism is additionally provided. The positioning mechanism includes a pair of upper positioning holes 841, 842 formed in the end wall 72 of the switch 7, a lower positioning hole 811 formed in a top end face of the C-shaped upper wall 64 of the positioning lid 6 and selectively aligned with one of the upper positioning holes 841, 842 when the switch 7 is moved selectively to one of the first and second positions, a positioning rod 86 having one end received in the lower positioning hole 811 and the other end extending out of the lower positioning hole 811, and an urging member 85 (which is preferably a coil spring) received in the lower positioning hole 811 for urging the other end of the positioning rod 86 to move selectively into one of the upper positioning holes 841, 842 when the switch 7 is moved selectively to one of the first and second positions.

Figure 8:
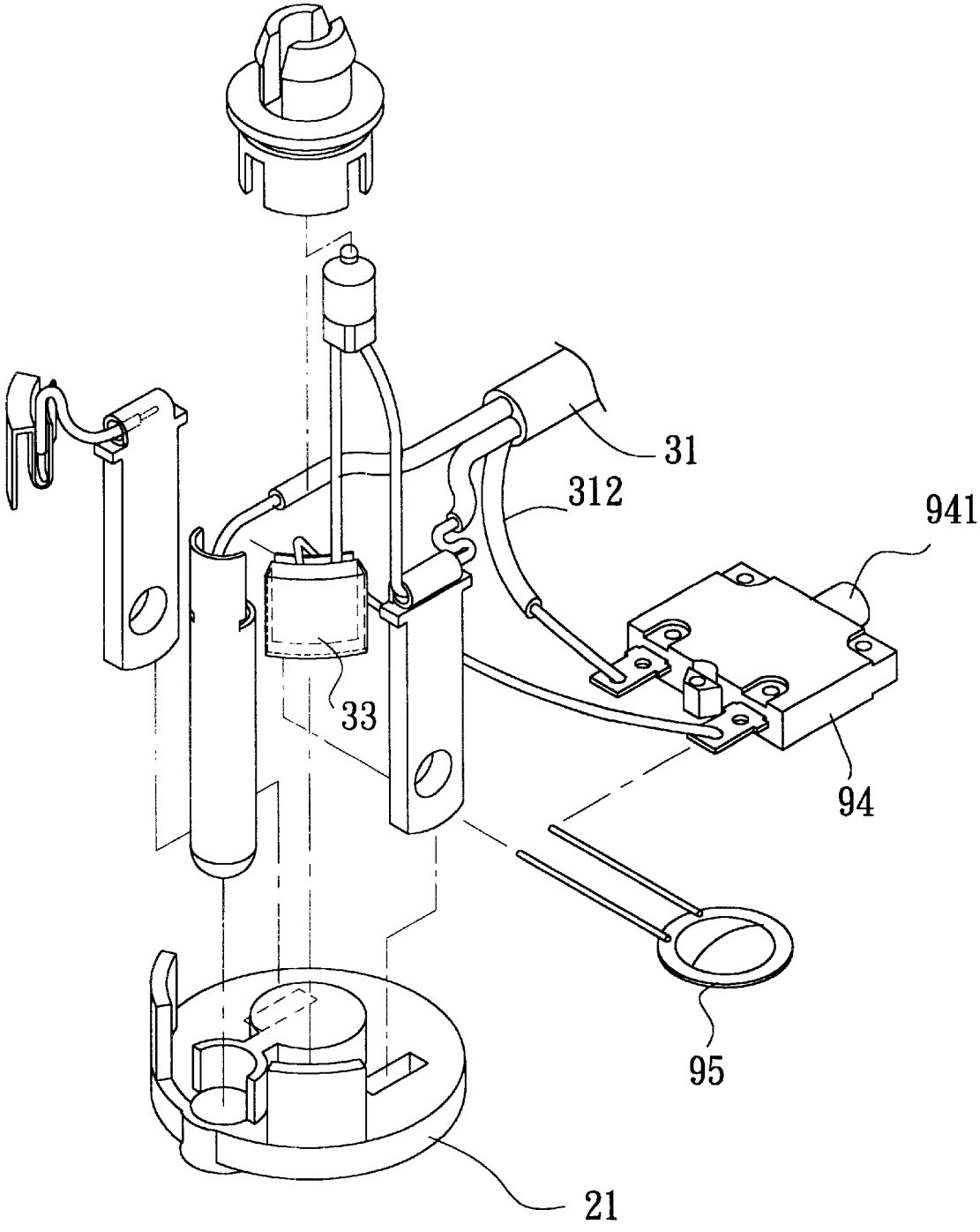
FIG. 8 is an exploded view of another modified power plug of the invention.
Figure 1:
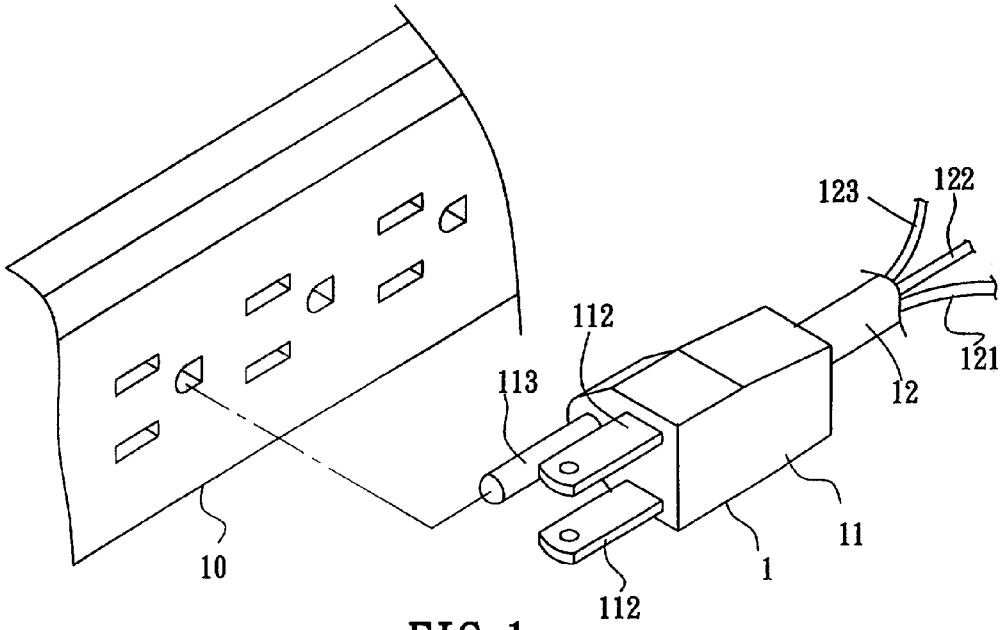
FIG. 1 PRIOR ART
Figure 2:
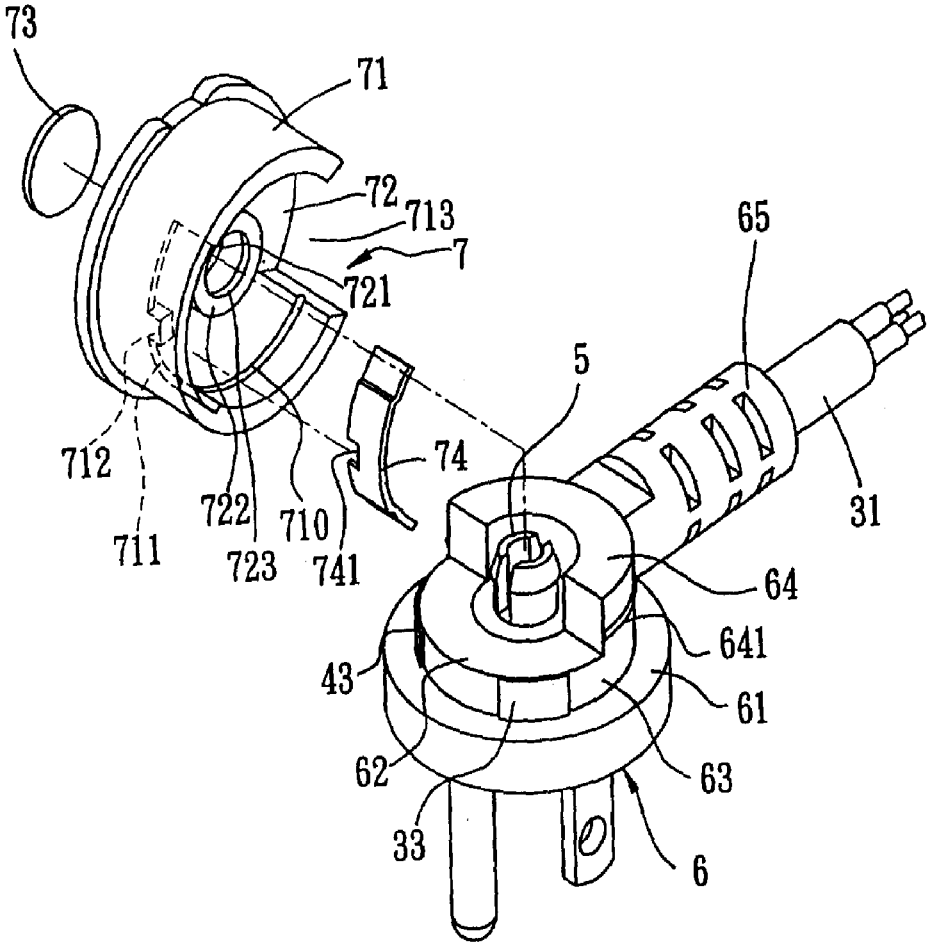
Figure 3:
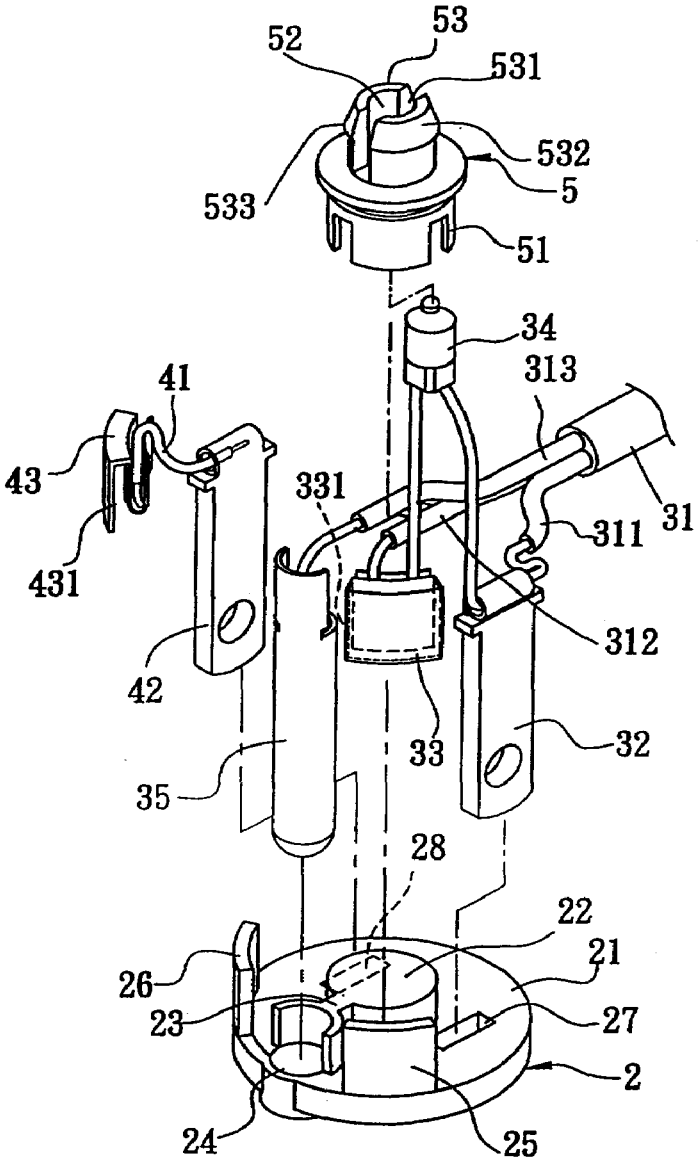
Figure 4:
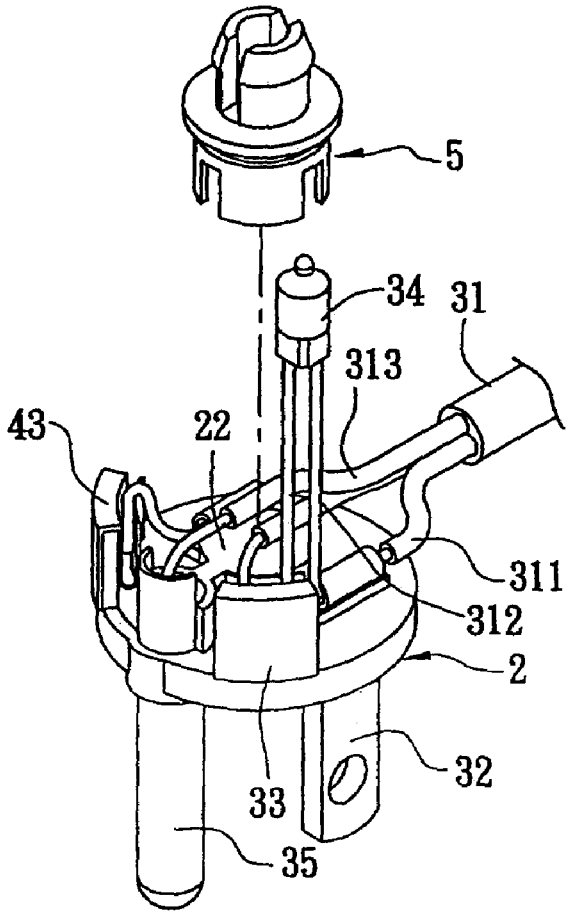

FIG. 8 illustrates another modified power plug of the invention. This modified power plug is similar to the previous embodiment shown in FIG. 2, except that an additional relay 94 and/or an additional voltage sensitive resistor 95 are further provided to interconnect the first conductive plate 33 and the first conductor 312 of the electric wire 31 in order to protect the power plug from any damage due to a high electric current or a high voltage. The relay 94 or the voltage sensitive resistor 95 is mounted on the base 21, and is covered by the positioning lid 6. A button 941 is provided on the relay 94 for restoring the same to a current passing state.

With the switch 7, the power plug can be disconnected from a receptacle without unplugging the power plug. The aforementioned drawbacks associated with the prior art can thus be eliminated.

With the invention thus explained, it is apparent that various modifications and variations can be made without departing from the spirit of the present invention. It is therefore intended that the invention be limited only as recited in the appended claims.

I claim:

1. A power plug comprising:

an insulative seat having a base and a post projecting upwardly from said base, said base having a pair of slits formed therein at two opposite sides of said post;

opposite arc-shaped first and second conductive plates projecting upwardly from said base and spaced radially apart from said post, said first conductive plate being connected to a first conductor of an electric wire;

first and second power plug blades secured to said base, and projecting downwardly and respectively from said base through said slits, said first power plug blade being connected to a second conductor of the electric wire, said second power plug blade being electrically connected to said second conductive plate; and a switch mounted rotatably on said post, and having an insulative end wall disposed above said base, an insulative peripheral wall projecting downwardly from said end wall toward said base and extending circumferentially to surround said first and second conductive plates, and a conductive arc-shaped bridging plate mounted on said peripheral wall, said switch being turnable about said post between a first position, in which said bridging plate bridges said first and second conductive plates, and a second position, in which said bridging plate disconnects said first and second conductive plates.

2. The power plug of claim 1, wherein said seat further has a pair of arc-shaped positioning protrusions projecting upwardly from said base, said first and second conductive plates being respectively mounted on said positioning protrusions and each having an inverted U-shaped portion defining a slot that opens downwardly and that has a shape conforming to the respective one of said positioning protrusions so as to receive fittingly the respective one of said positioning protrusions.

3. The power plug of claim 1, wherein said base further has an aperture formed therein, said power plug further comprising a ground pin secured to said base, projecting downwardly through said aperture, and connected to a ground conductor of the electric wire, said seat further having a C-shaped protrusion connected to said post and projecting upwardly from said base adjacent to said aperture.

4. The power plug of claim 1, wherein said peripheral wall of said switch has an inner recess formed therein and having a shape conforming to said bridging plate for receiving fittingly said bridging plate, and a tongue projecting therefrom into said inner recess, said bridging plate having a groove engaging said tongue.

5. The power plug of claim 1, wherein said seat further has a switch supporting member that has a lower annular part formed with a plurality of notches and sleeved fittingly around said post, and an upper part having a pair of opposite arc-shaped protrusions that project upwardly from said lower annular part, that define a slot therebetween, and that respectively have anchoring ends, said end wall of said switch having a central opening formed therein and aligned with said slot in said upper part, and an annular flange projecting from a periphery of said central opening to receive said anchoring ends of said protrusions of said upper part, said annular flange having an inner annular groove formed therein and engaging said anchoring ends of said protrusions of said upper part.

6. The power plug of claim 5, wherein said switch further has a transparent cover mounted on said end wall for covering said central opening, said power plug further comprising a lamp mounted in said slot and electrically connected to said first conductive plate and said first power plug blade.

7. The power plug of claim 5, wherein said peripheral wall of said switch further has a circumferentially extending inner groove below said inner recess, said seat further having a positioning lid mounted on said base and having a lower annular wall sleeved fittingly around a peripheral edge of said base, an upper annular wall reduced and extending upwardly from said lower annular wall to surround fittingly said lower annular part of said switch supporting member, a C-shaped upper wall projecting upwardly from said upper annular wall at a position opposite to said conductive plates and surrounding a portion of said upper part of said switch supporting member, and an arc-shaped lip projecting outwardly and radially from a bottom side of said C-shaped upper wall toward said peripheral wall to engage said inner groove in said peripheral wall.

8. The power plug of claim 7, wherein said peripheral wall of said switch further has a notch formed therein, said positioning lid further having a cord sleeve extending outwardly from said C-shaped upper wall through said notch in said peripheral wall and adapted to receive the electric wire therein.

9. The power plug of claim 7, wherein said end wall of said switch further has a pair of upper positioning holes formed therein, said C-shaped upper wall of said positioning lid further having a top end face formed with a lower positioning hole that is selectively aligned with one of said upper positioning holes when said switch is moved selectively to one of said first and second positions, said power plug further comprising a positioning rod having one end received in said lower positioning hole, and the other end extending out of said lower positioning hole, and an urging member received in said lower positioning hole for urging said other end of said positioning rod to move selectively into one of said upper positioning holes when said switch is moved selectively to one of said first and second positions.

10. The power plug of claim 1, further comprising a relay to interconnect said first conductive plate and the first conductor.

11. The power plug of claim 1, further comprising a voltage sensitive resistor to interconnect said first conductive plate and the first conductor.

* * * * *

UNITED STATES PATENT AND TRADEMARK OFFICE

CERTIFICATE OF CORRECTION

PATENT NO. : 6,303,883 B1
DATED : October 16, 2001
INVENTOR(S) : Ho

It is certified that error appears in the above-identified patent and that said Letters Patent is hereby corrected as shown below:

Title page,
The title page showing the illustrative figure, should be deleted and substitute therefor the title page as shown on the attached page.

Drawings,
Delete Drawing Sheets 1 - 4 and substitute the attached Drawing Sheets 1 - 4.

Signed and Sealed this

Thirteenth Day of August, 2002

*Attest:*

*Attesting Officer*

JAMES E. ROGAN
*Director of the United States Patent and Trademark Office*

(12) United States Patent
Ho

(10) Patent No.: US 6,303,883 B1
(45) Date of Patent: Oct. 16, 2001

(54) POWER PLUG

(75) Inventor: Hsien-Wen Ho, Tainan (TW)

(73) Assignee: Chi-Wen Chen, Taipei City (TW)

( * ) Notice: Subject to any disclaimer, the term of this patent is extended or adjusted under 35 U.S.C. 154(b) by 0 days.

(21) Appl. No.: 09/703,991

(22) Filed: Oct. 31, 2000

(51) Int. Cl.[7] ..... H01R 13/70
(52). U.S. Cl. ..... 200/51.12; 200/51 R
(58) Field of Search ..... 200/11 R, 17 R, 200/51 R, 51.05, 51.06, 51.07, 51.11, 51.12, 334, 336, 564, 570, 571

(56) References Cited

U.S. PATENT DOCUMENTS 3,943,310 * 3/1976 Gertz ..... 200/51 R
4,008,382 * 2/1977 DeRosa ..... 200/51 R
4,969,833 * 11/1990 Lindow et al. ..... 439/133
5,193,665 * 3/1993 Jankow ..... 200/43.8

* cited by examiner

*Primary Examiner*—Michael Friedhofer
(74) *Attorney, Agent, or Firm*—Ohlandt, Greeley, Ruggiero & Perle, L.L.P.

(57) ABSTRACT

A power plug includes a seat having a base and a post, first and second conductive plates projecting upwardly from the base, first and second power plug blades projecting through the base, and a switch mounted rotatably on the post and having an end wall disposed above the base, a peripheral wall surrounding the first and second conductive plates, and a bridging plate mounted on the peripheral wall. The switch is turnable about the post between a first position, in which the bridging plate bridges the first and second conductive plates, and a second position, in which the bridging plate disconnects the first and second conductive plates.

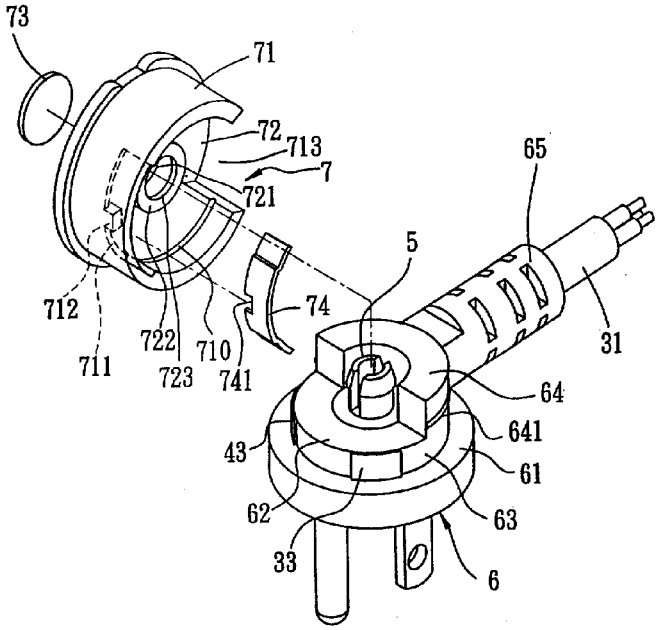

11 Claims, 8 Drawing Sheets